United States Patent [19]

Moeller

[11] 4,316,165

[45] Feb. 16, 1982

[54] ELECTROMAGNETIC RELAY WTH ADD-ON CONDUCTOR CAPABILITY

[75] Inventor: Helmut Moeller, Munich, Fed. Rep. of Germany

[73] Assignee: Siemens Aktiengesellschaft, Berlin and Munich, Fed. Rep. of Germany

[21] Appl. No.: 112,457

[22] Filed: Jan. 16, 1980

[30] Foreign Application Priority Data

Mar. 30, 1979 [DE] Fed. Rep. of Germany ... 7909155[U]

[51] Int. Cl.[3] ..... H01H 9/12

[52] U.S. Cl. ..... 335/202; 335/278; 335/132; 174/51

[58] Field of Search ..... 335/202, 156, 162, 278, 335/292, 294, 132; 174/51

[56] References Cited

U.S. PATENT DOCUMENTS 3,202,785 8/1965 Jelley ..... 335/132

4,095,073 6/1978 Frank ..... 174/51

FOREIGN PATENT DOCUMENTS 28276 56 10/1980 Fed. Rep. of Germany ..... 335/132

*Primary Examiner*—L. T. Hix
*Assistant Examiner*—S. D. Schreyer
*Attorney, Agent, or Firm*—Hill, Van Santen, Steadman, Chiara & Simpson

[57] ABSTRACT

An electromagnetic relay is disclosed having a ground connection in the form of a bent lead wire soldered on to an end of the asembly on an exterior side of the yoke. A base member of the relay, which comprises insulating material, has on its exterior side grooves in which the bent lead wire is guided from the housing to a pattern point on the connection side. It is thereby possible to manufacture the relay in the normal case without a ground connection and, where required, to subsequently apply the ground connection.

7 Claims, 2 Drawing Figures

ELECTROMAGNETIC RELAY WTH ADD-ON CONDUCTOR CAPABILITY

BACKGROUND OF THE INVENTION

The invention concerns an electromagnetic relay with an insulating material base member which forms a base. The base member has a hinged or spring armature magnet system with coil, yoke and armature as well as also contact assemblies. Connection pins for the coil winding and for the contact assembly are guided through penetrations of the base to the connection side of the relay. Also, a protecting cap is provided which encompasses the base.

In the case of known relays of this sort, in general no ground connection is provided for the parts of the magnet system. For particular applications, nevertheless, a ground connection is desired. For this purpose, in the case of current relays, the construction had to be designed for this possibility. Since the ground connection in the case where it is needed must lie in the connection pattern of the rest of the relay connections, its own perforation was provided in the base of the base member and, when needed, provided with a connection element. The assembly of this connection element, nevertheless, had to proceed in an early stage of the manufacturing together with the remaining connection elements for contacts and coil winding. For this reason, the entire manufacturing process had to be adjusted for the special case of this ground connection and also its own mounting had to be provided for the special embodiment.

It is an object of the invention to provide a ground connection for a relay such that it can be produced simply and inexpensively, and, when needed, can be attached onto the finished assembled relay. According to the invention, this is attained with an additional connection conductor which is connected electrically with the yoke and runs on the magnet system along the interior side of the protecting cap. This additional conductor is guided in a groove, which corresponds at least to the size of the conductor, along the exterior side and along the connecting side of the base to a pattern point and there is bent at a right angle for the formation of a connection pin.

By means of the construction according to the invention, the ground connection can be applied subsequently to the finished assembled relay before the application of the protecting cap. This is possible since the ground connection is guided, not through borings of the base member, but rather via grooves which lie on the outside. With the exception of these grooves, no consideration must be taken regarding the embodiment with ground connection during the total relay construction. In the normal embodiment of the relay, therefore, only the grooves which run along around the base need be provided, which grooves nevertheless do not change or influence the relay whether or not the ground lead is provided.

It is practical to use as a connection conductor a wire which is bent into the corresponding form, which, for example, can consist of tinned Argentan. The connection of the connection conductor with the yoke proceeds in a practical manner by means of spot welding upon welding ribs. In a further design of the invention, it can further be provided that the connection conductor serves as a coil connection in addition to the connection with the yoke. The case can occur in which, for two separated coil windings, a center tap is to be connected with the ground tap.

DESCRIPTION OF THE PREFERRED EMBODIMENTS

Figure 1:
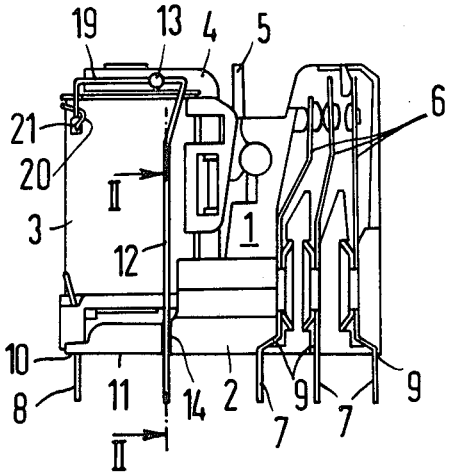
FIG. 1 shows an electromagnetic relay in a side view with a ground connection.
Figure 2:
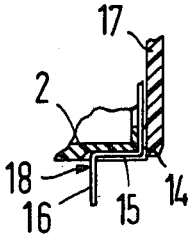
FIG. 2 shows a detailed section II—II from FIG. 1.

FIG. 1 shows an electromagnetic relay with known basic structure. Upon a base member 1 with a base 2, on the one side a magnet system is arranged with a coil 3, a yoke 4 and an armature 5. Further, the base member 1 bears two contact assemblies (only one can be seen) with the contact springs 6 and their connection pins 7. The coil winding has the connection pins 8 (only one to be seen). All these connection pins 7 and 8 are guided in penetrations or perforations 9, or respectively, 10 to the connection side 11 of the base 2. These perforations can be opened toward the side (perforation 9), or they can be embodied as closed borings (perforation 10). What is essential in the case of the provision of connection pins is that they already lie in a pattern of the desired connection configuration. The connection elements must therefore be inserted into these perforations during the manufacturing of the relay in a suitable manner. If then for specific cases of application, after manufacturing of the relay a ground connection is to be provided, that is, in particular for the yoke 4, then according to the invention a lead wire 12 is bent into a corresponding form and is arranged laterally on the magnet system. This lead wire 12 is spot welded at the location 13 with the yoke, whereby the lead wire 12 normally ends at this location 13. The other end is guided according to FIG. 2 in a groove 14 on the side of the base 2, then is bent around the lower edge of the base and is guided further in a groove 15 on the connection side up to the desired pattern point 18. There, the free end 16 of the lead wire 12 is again bent at a right angle so that it forms a connection pin which stands in the desired raster pattern with the remaining connection pins 7 and 8. The grooves 14 and 15 must therefore have a depth which corresponds at least to the size of the lead wire 12. After the attachment of the lead wire 12, a protecting cap 17 can be pushed over the relay and the base 2, whereby the lead wire is held fast in the groove 14 by means of the protecting cap.

As is shown in FIG. 1, the lead wire 12 can, when needed, be extended beyond the welding spot 13 and can be used as an additional coil connection 19. In this manner, for example, a center tap of the coil winding can be connected on to the coil winding and this center tap is connected electrically with ground. In this case, the coil wire 20 is soldered onto the end 21 of the lead wire 12 which has been pinched flat.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. An electromagnetic relay, comprising: an insulating material base member which forms a base; the base member bearing an armature magnet system with coil, yoke and armature as well as coil winding and contact connecting pins guided through perforations of the base to a connection side of the relay base; a protecting cap encompassing the relay; and an additional connection conductor electrically connected with the yoke positioned on the magnet system along an interior side wall of the protecting cap to and within a groove at an exterior side edge of the base which corresponds at least to a thickness of the connection conductor, and also along the connection side of the base to a connection pin pattern point and there is bent to form a connection pin.

2. A relay according to claim 1 wherein the connection conductor comprises a wire which is pre-bent.

3. A relay according to claim 1 wherein the connection conductor is fastened on the yoke by a spot weld.

4. A relay according to claim 1 wherein the connection conductor is additionally connected with a coil connection.

5. A relay according to claim 1 wherein the connection conductor is held in the groove on the exterior side of the base by the protecting cap.

6. An electromagnetic relay, comprising: an insulating material base member which forms a mounting base; the base member having a relay mounted thereon which is wired to electrical connecting pins mounted in perforations of the base and extending to a connection side of the base in a connecting pin pattern; a protecting cap encompassing the relay and fitted to overlap the base; an additional connection conductor electrically connected with the relay and positioned to run towards the base and into a groove opened to the outside on an exterior side wall of the base; said connection conductor being retained in the exterior groove by a portion of the overlapping side wall of the protecting cap; and the additional connection conductor being formed such that it lies against the connection side of the base and runs to a desired connection pattern point where it is bent to form an additional connection pin, whereby the additional connection conductor can be added to the completed relay without adding a perforation in the base.

7. The electromagnetic relay of claim 6 wherein a groove is provided on the connection side of the base within which the additional connection conductor is positioned.

* * * * *